United States Patent [19]

Doonan et al.

[11] Patent Number: 4,816,090

[45] Date of Patent: Mar. 28, 1989

[54] HEAT TREATED COLD ROLLED STEEL STRAPPING

[75] Inventors: Jeffery W. Doonan, Figtree; Peter I. Unicomb, Kiama Downs; Robert K. Armstrong, Minnamorra, all of Australia

[73] Assignee: The Broken Hill Proprietary Co., Ltd., Victoria, Australia

[21] Appl. No.: 71,293

[22] Filed: Jul. 9, 1987

[51] Int. Cl.[4] ..... C22C 38/12

[52] U.S. Cl. ..... 148/320; 148/337; 148/902

[58] Field of Search ..... 148/902, 320, 337

[56] References Cited

U.S. PATENT DOCUMENTS

| | | | |
|---|---|---|---|
| 3,378,360 | 4/1968 | McFarland | 148/12.4 |
| 3,551,216 | 12/1970 | Severing et al. | 148/12 F |
| 3,761,323 | 9/1973 | Hunt et al. | 148/12.1 |
| 4,062,700 | 12/1977 | Hayami et al. | 148/12 F |

*Primary Examiner*—Christopher W. Brody

*Attorney, Agent, or Firm*—Nixon & Vanderhyde

[57] ABSTRACT

A method of heat treating cold rolled steel strapping comprising rapidly heating the strapping to the dual phase temperature range at a rate of the order of 100° C. per second, with little or more soaking, and rapidly cooling the strapping at a rate of the order of 1000° C. per second to form a microstructure comprising a matrix of recovery annealed cold work ferrite containing martensite and carbides dispersed through the matrix. A heat treatment line for performing this method is described. A heat treated cold rolled steel strapping produced by the method is also described. The steel from which the strapping is made preferably has less than 0.2° C. and includes Ti in the range 0.06 to 0.15% preferably about 0.08% and Nb in the range 0.02 to 0.05% preferably about 0.04%.

13 Claims, 4 Drawing Sheets

Matrix of recovery annealed ferrite

Matrix of recovery annealed ferrite

HEAT TREATED COLD ROLLED STEEL STRAPPING

FIELD OF THE INVENTION

This invention relates to heat treated steel strapping, and more particularly to a method of and an apparatus for heat treating steel strapping, and the improved strapping so produced.

BACKGROUND OF THE INVENTION

Steel strapping is formed by slitting cold rolled steel strip into the required width and is used in a variety of applications which require a range of properties. Generally, the properties which must be considered when producing strapping are tensile strength, ductility, notch properties and work hardening. These properties are dependent on the composition of the steel and the heat treatment processes applied to the strapping.

The minimum tensile strength of steel strapping varies between 500 and 1250 MPa. Strapping having tensile strengths in the range 500 to 800 MPa is manufactured and sold by the applicant as 'standard' strapping and strapping having tensile strengths in excess of 800 MPa is manufactured and sold by the applicant as 'super' strapping.

Standard strapping is generally formed from low carbon steels and may be used in its cold rolled and slit form without heat treatment in applications requiring moderate strength levels, for example in the securing of cardboard cartons to pallets. In some instances standard strapping is formed from medium carbon steels and is subjected to a stress relief annealing treatment or a blueing heat treatment in order to improve ductility.

Super strapping is generally formed from medium carbon steels and the strapping is subjected to heat treatment to provide the required properties. Super strapping is used in heavy duty applications requiring medium to high tensile strength and good ductility, notch properties and work hardening. Uses include unitising of steel pipe into bundles, the fastening of heavy loads to pallets and containing high density wool and cotton bales.

The conventional heat treatment process for super strapping, which is a version of the so-called Austemper process, comprises:

(a) heating cold rolled steel strapping (generally having a carbon content between 0.20 and 0.60%) to between 800° C. and 900°, to transform the structure to austenite, (b) fast cooling the strapping in a lead or salt bath to a temperature between 350° and 500° C., to initiate transformation from austenite to bainite, (c) air cooling the strapping for a short period of time to allow transformation of any remaining austenite, and (d) quenching the strapping to ambient temperatures.

It is known that bainite has acceptable properties for medium to high tensile strength strapping. However, the Austemper process has a number of disadvantages.

First, there is a substantial capital cost associated with the use of lead, as well as costs to replace lead lost through oxidation and lead "drag-out" on the strip, costs associated with loss of product due to intermittent lead contamination of the strip, cost of maintenance of the lead baths and costs associated with minimising environmental and health problems generally associated with lead.

Second, the speed of the heat treatment process is limited by the cooling power of the lead bath and the need to allow sufficient time at the transformation temperature range for transformation of austenite to bainite. The required increase in the length of the lead quench bath necessary to allow sufficient time at the quench temperature to enable complete transformation of austenite to bainite at higher speeds would be cost prohibitive.

A third disadvantage is associated with the need to use sufficiently high carbon and manganese levels to avoid martensite formation during heat treatment with the countervailing requirements to keep the analysis lean to minimise steelmaking problems. In this regard, it is the desire of the steel maker to keep the carbon content of his steel as low as possible to avoid steel making problems. However, the lower the carbon content, the more difficult it is to produce bainite because the temperature at which martensite forms increases, and the Austemper process becomes less and less useful.

Another heat treatment process for producing higher strength steels, known as the Continuous Annealing line process, may appear at first sight to overcome certain of the problems associated with the Austemper process, but the process still has some shortcomings. The process involves a 25 to 40 sec heat up period, a 10 to 120 sec soaking period followed by a 0.5 to 30 sec cooling period. This process results in a dual phase ferrite/martensite steel, which requires a soaking period of at least 10 seconds for stable formation of ferrite and autenite phases which transform under fast cooling to ferrite and martensite. The major strengthening factor is the amount of hard martensite phase (15 to 60%) which may be assisted by ferrite strengtheners such as cold worked structure. A 15% structure would require other strengthening factors to achieve properties which are achieved according to the present invention.

SUMMARY OF THE INVENTION

The object of the present invention is to provide an improved steel strapping and method of and apparatus for producing the strapping by an improved heat treatment process, which at least ameliorates the disadvantages described in the preceding paragraphs and which results in a treated steel strapping having a novel microstructure and improved properties.

In accordance with the present invention there is provided a method of heat treating cold rolled steel strapping comprising, rapidly heating the strapping to the dual phase temperature range, with little or no soaking, and rapidly cooling the strapping to form a microstructure comprising a matrix of recovery annealed cold worked ferrite containing martensite and carbides dispersed throughout the matrix.

The term "dual phase" as used herein is understood to mean the phase equilibrium region where austenite and ferrite phases co-exist.

In another aspect, the invention provides a heat treated cold rolled steel strapping which is characterized by a microstructure comprising a matrix of recovery annealed cold worked ferrite containing martensite and carbides dispersed through the matrix.

The martensite and carbides preferably comprises less than 20% by volume of the microstructure.

The composition of the steel preferably comprises less than 0.2%C and is characterised by alloying elements which form particles which retard recrystallisation and act as precipitation strengtheners, for example titanium and preferably also Niobium. Titanium may be present in the range 0.06–0.15% and preferably 0.08% while Niobium may be present in the range 0.02 to 0.05% and preferably about 0.04%. The steel also preferably contains manganese in the range 1 to 2%, preferably about 1.45% and silicon in the range 0.2 to 0.4%, preferably about 0.33%.

The method according to the invention results in a tri-phase recovery annealed cold worked ferrite/martensite/carbide steel and is characterised by a short heating/soaking cycle. This results in only some carbides with favourable compositions transforming to austenite and thus to martensite on rapid cooling. Many carbides go through the transformation without appreciable change. With the microalloying elements (such as Ti, Nb) present, this cycle results in a tri-phase structure of recovery annealed cold worked ferrite containing martensite in the region of 5% and carbides in the region of 10%.

In each of the above aspects, the carbides are present in the form of fine spheroidal cementite and fine fragmented cementite. The fine fragmented cementite is a consequence of the rapid heating step and the absence of any appreciable soaking.

In accordance with the present invention there is also provided a heat treatment line for cold rolled steel strapping comprising, heating means to rapidly heat the cold rolled steel strapping to the dual phase temperature range with little or no soaking, and cooling means to cool the strapping to form a microstructure comprising a matrix of recovery annealed cold worked ferrite containing martensite and carbides dispersed throughout the matrix.

Since the Austemper process can be used only to form a structure containing bainite, a new type of heat treatment line which enables the required short rapid heating time and rapid cooling necessary to achieve the new microstructure is provided by the present invention. In its presently preferred form, the heating line comprises a series of solenoid induction heating coils followed by a rapid cooling station including a series of water nozzles directed at either side of the heated strapping as it emerges from the heating coils.

The heating period is selected to provide a balance between the consumption of power by the heating coils and the required speed which the heat treating line is to operate. In most existing plants, the speed of operation will be dictated by considerations relating to the coiling and painting plants which are usually already present at the plant and accordingly substantial speed gains will not be possible. However, in the case of a fresh site, line speeds of up to 600 m/min will be possible using the apparatus to be described further below. Thus, heating periods as low as two seconds and as high as 16 seconds may be required, but using heating rates of between 70° to 140° C. per second, and preferably about 100° C. per second, the most likely heating period range should be about six to ten seconds. The heating period comprises little or no soaking period although periods of from one to several seconds may occur without adverse results.

The cooling rate should be sufficiently high to ensure that the required regions of martensite are formed in the matrix. A cooling rate greater than 900° C. per second, and preferably desirably at least 1000° C. per second should achieve acceptable results.

BRIEF DESCRIPTION OF THE DRAWINGS

Further detailed description of the present invention will now be provided with reference to the accompanying drawings in which.

DESCRIPTION OF PREFERRED EMBODIMENT

The present invention is based on the realization that steel having a microstructure comprising a matrix of recovery annealed cold worked ferrite with martensite and carbides dispersed throughout the matrix exhibits suitable properties for use as 'super' strapping. As a consequence, the micro-structure is an acceptable substitute for bainite which is the predominant constituent in strapping formed by the Austemper process.

In the preferred embodiment the microstructure is formed by a heat treatment method which is based on the use of induction heating to heat the strapping.

Figure 1:
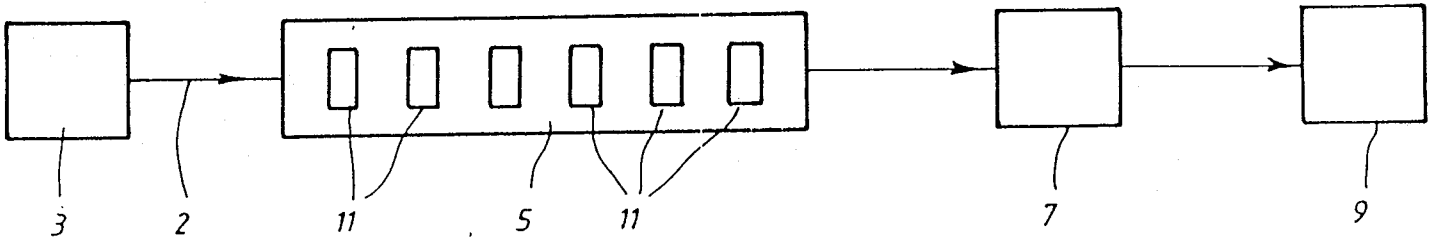
FIG. 1 is a schematic diagram showing a preferred embodiment of the heat treatment line.

With reference to FIG. 1, in the heat treatment line of the preferred embodiment, the cold rolled steel strapping 2 is fed from a coil unwinding station 3 through an induction heating station 5 and a cooling station 7 to a coil winding station 9.

The induction heating station 5 comprises a number of solenoid induction heating coils 11, for example six, connected in series and arranged to allow the strapping to pass through the coils. Each induction heating coil 11 is preferably connected to a 5 to 25 kilohertz Statipak STK 4 power unit manufactured by Inductoheat Pty. Ltd. It will be appreciated that any other suitable induction heating coil and power supply combination may be used although a 5 to 25 kilohertz power supply is preferred.

Figure 2:
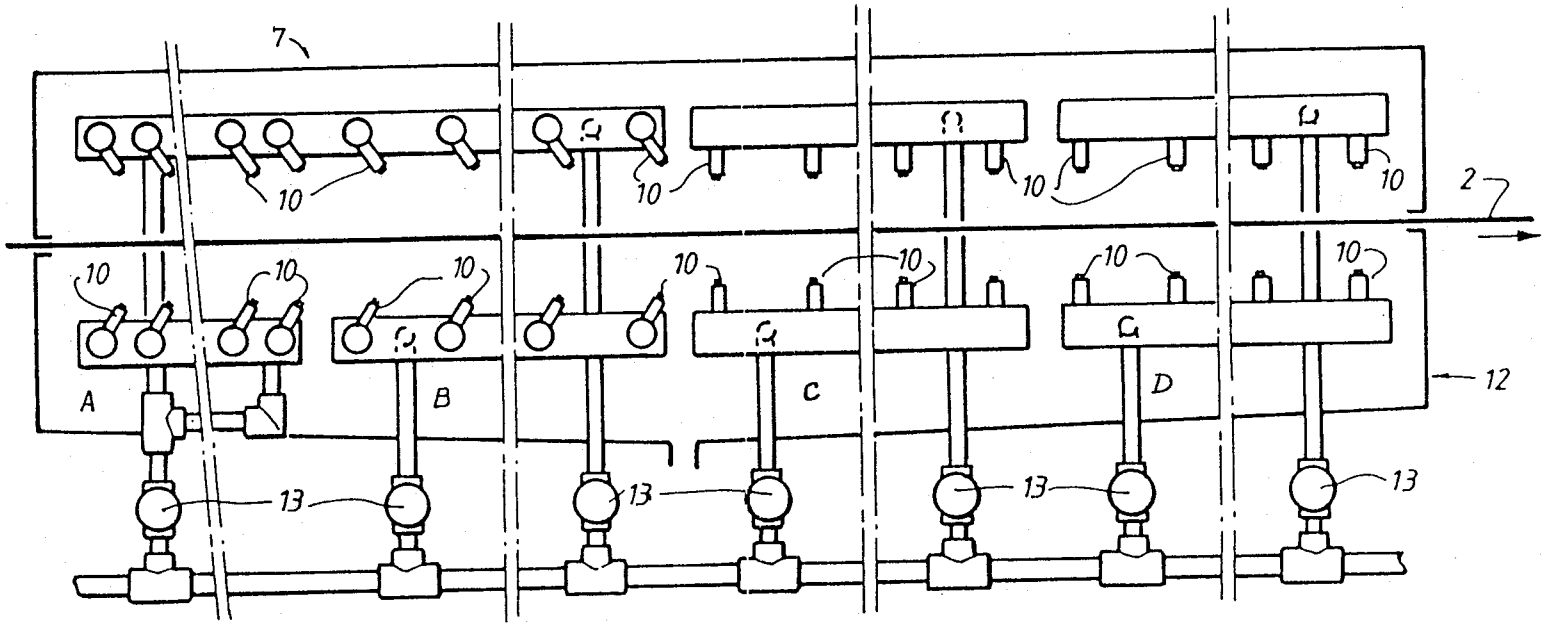
FIG. 2 shows one preferred cooling arrangement for the line of FIG. 1.

As shown in greater detail in FIG. 2 of the drawings, the cooling station 7 comprises a plurality of nozzles 10 positioned within a housing or tank 12 to direct sprays of water onto the surfaces of the strapping 2. In the embodiment shown, the nozzles 10 are arranged in four groups A to D with the nozzles 10 in groups A and B being angularly adjusted so as to be directed away from the heating coils 11, that is, in the direction of travel of the strip 2, and the nozzles 10 in groups C and D being fixed perpendicularly to the surfaces of the strapping 2. The angular adjustment of the nozzles in groups A and B reduces the likelihood that cooling water will travel along the strapping and enter the induction heating coils 11.

The mains water supply to the headers supporting the nozzles 10 includes separate control valves 13 for the upper and lower headers so that flow to the upper and lower nozzles 10 may be separately controlled. The number of nozzles 10 and the controlled flow rate are selected to achieve the desired cooling rate discussed in greater detail below.

In use, the cold rolled steel strapping 2 fed from the coil unwinding station 3 is heated to the dual phase temperature range as it passes through the solenoid induction coils 11 and is then quenched by water sprayed at the cooling station 7.

It is preferred that the composition of the steel is selected to comprise less than 0.2%C and alloying elements which form particles which retard recrystallization and which act as precipitation strengtheners, such as titanium and niobium. In one Example, the steel has the following composition:

C: 0.16% P: 0.023% Mn 1.45% Si 0.33% S: 0.010% Ni 0.028% Cr 0.030% Mo:0.005% Ca 0.013% Al 0.029% Nb:0.041 Ti 0.080% N 0.0075%

In the above Example, the values given for each element are not critical or essential. For example Ti may vary between 0.06% and 0.15% while Nb may vary between 0.02% and 0.05%, Mn may vary between 0.5% and 2% and Si may vary between 0.2% to 1.5%.

Figure 3:
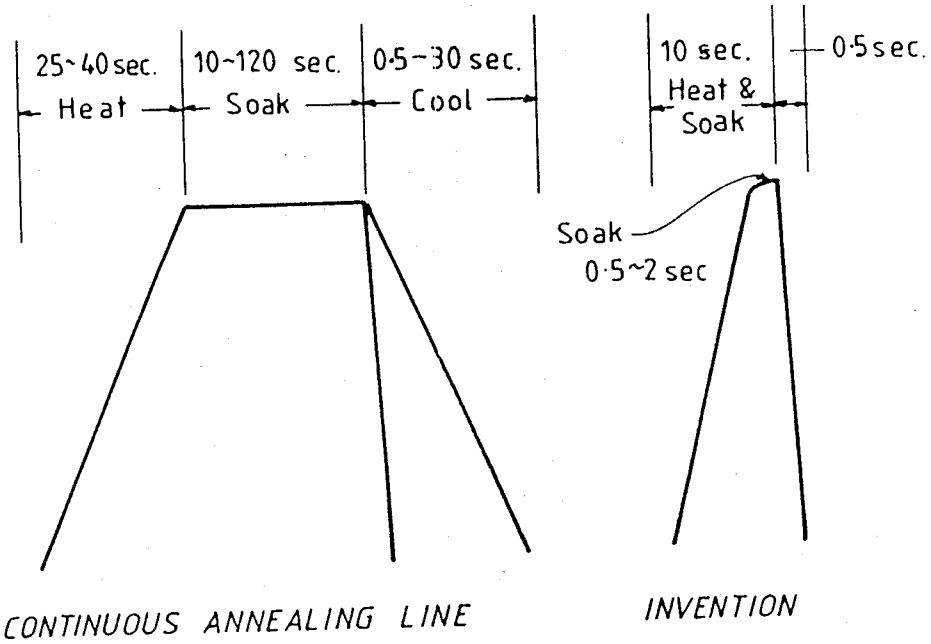
FIG. 3 shows schematically the process stages for a typical continuous annealing line and for the line embodying the invention.

The solenoid induction heating coils 11 heat the steel to the Curie Temperature, which is within the dual phase temperature range, at a heating rate of between 70° to 140° C. per second, preferably approximately 100° C. per second. The overall heating period before cooling should not exceed about 20 seconds and includes little if any soaking to minimize significant recrystallization of the ferrite. In this regard, FIG. 3 shows a comparison of a process prepared on a typical continuous annealing line with the process of the present invention. Under the conditions of the present invention some of the pearlite and a proportion of the ferrite in the steel transforms to austenite and the remaining ferrite stress relief anneals. Further, on a microscale there is some recrystallization of the ferrite (limited by the short heating time and the absence of soaking), although on a macro-scale the ferrite retains its oriented elongate grains reflecting the previous cold rolling. The minimal recrystallization on the macroscale is due principally to the titanium and niobium additions. TiC in particular retards recrystallisation considerably.

As mentioned above, the flow rate of water and the number of nozzles 10 used in the cooling station 7 is selected so that the cooling rate is greater than about 900° C. per second and preferably about 1000° C. per second. This cooling rate is sufficiently high to transform the austenite to martensite to achieve the preferred microstructure in the strapping.

The composition of the steel and the operating conditions of the heat treatment line, such as the heating rate and the speed of the strapping through the line, are selected so that on heating to the dual phase range from about 5 to 20% pearlite and ferrite are transformed to austenite. The reason for this is that it has been found that where the micro-structure contains more than about 20% martensite, the martensite can form as a continuous constituent with the result that the notch strength of the strapping is significantly reduced to unacceptable levels.

The control of the heating conditions is significantly simplified by reliance on the Curie temperature, which is approximately 770° C. and therefore within the dual phase range. The Curie temperature as used herein is understood to mean the critical temperature above which steel is non-magnetic and below which steel is magnetic. As a consequence of heating of the strapping by the solenoid induction heating coils, the heating efficiency substantially reduces above the Curie temperature.

This phenomenon is used in two ways. First, it prevents the strapping from overheating much beyond the Curie temperature, thereby eliminating overheating problems. Second, by choosing the Curie temperature as the annealing temperature (and varying the chemical composition of the steel in order to achieve the necessary properties for the strapping based on the Curie temperature as the annealing temperature) the change in heating efficiency enables natural control of the strapping temperature both on a macro and micro scale. For example, this control eliminates overheating of any part of the cross-section of the strapping and the constant annealing temperature enables the production of consistent and reproducible properties.

Figure 4B:
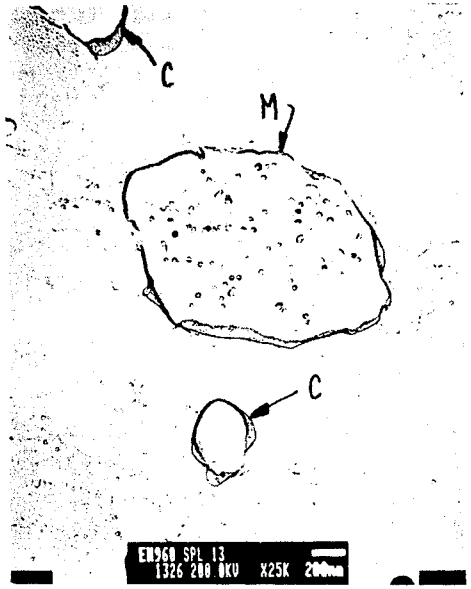
FIGS. 4A and 4B respectively show transmision electron micro-graphs (×4100 and ×25,000 respectively) of the micro-structure after heat treatment.
Figure 4A:
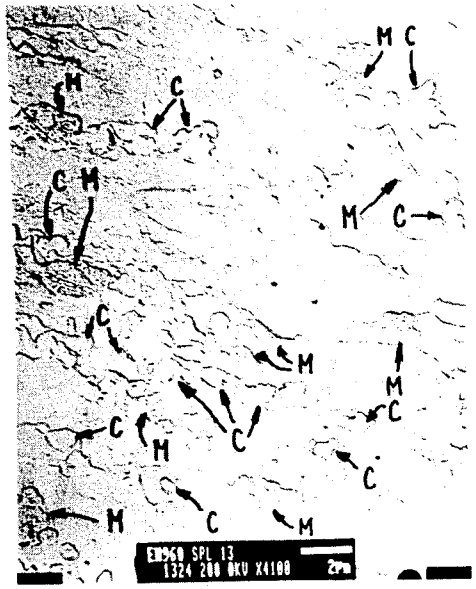

The resultant microstructure will be seen from the micrographs of FIGS. 4A and 4B to comprise matrix of recovery annealed cold worked ferrite with martensite m and carbides c dispersed discontinuously through the matrix. This microstructure has been found to exhibit the required properties for super strapping. In particular, it has been found that it is possible to form strapping having tensile strengths ranging from about 800 MPa to 1000 MPa with acceptable ductility and notch properties throughout the range of tensile strengths.

Furthermore, it has been found in laboratory tests thus far conducted that there is only a minimal variation in the order of 20 Mpa in tensile strengths of strapping of the same composition but thicknesses varying between 1.5 mm and 0.5 mm. On the other hand, strapping heat treated in accordance with the Austemper process has been found to exhibit a variation in the order of 300 MPa over the same thickness range.

In the steel composition described in the Example 1 the following properties were produced. For comparison purposes, the properties of Super Strapping produced by the Austemper process are quoted in brackets.

Ultimate Tensile Strength

Average: 955 MPa (935 Mpa)
Range: 890–1070 MPa (831–1000 Mpa)

Elongation

Average: 14% (10%)
Range: 12–16% (7–14%)

Reverse Bends to Failure

Average: 11 (Typical—6)
Range: 8–15

The ultimate tensile strengths of the new product are similar and satisfactory for this product. However, the elongation and reverse bend values of the new product are superior to the Austemper product. This may give a better performance in use than the conventional product, which already performs satisfactorily in use.

The described heat treatment line enables the heating treatment of cold rolled steel to form microstructures having suitable properties for use as strapping and thus represents an alternative to the Austemper process. Further, the heat treatment line is not subject to the disadvantages of the Austemper process associated with the use of lead. However, it should be appreciated that whilst the use of induction heating is most preferred since it enables excellent "automatic" control of the heating of the strapping in the described heat treatment line, any suitable means for rapidly heating the strapping to the dual phase temperature range could be used.

We claim:

1. Steel strapping when produced by a method comprising rapidly heating said strapping to the dual phase temperature range, with little or no soaking, and rapidly cooling the strapping to form a microstructure comprising a matrix of recovery annealed cold worked ferrite containing martensite and carbides dispersed throughout said matrix.

2. Steep strapping according to claim 1, wherein the strapping is heated at a rate of between 70° to 140° per second and the strapping is cooled at a rate greater than about 900° C. per second.

3. Steel strapping according to claim 2, wherein the strapping is heated at a rate of the order of 100° C. per second and is cooled at a rate of the order of 1000° C. per second.

4. Steel strapping according to claim 1, wherein the strapping is heated to the Curie temperature and the heating period does not exceed about 20 seconds.

5. Steel strapping according to claim 4, wherein the heating is about 6 to 10 seconds.

6. Steel strapping according to claim 5, wherein the steel has less than 0.2% C and includes Ti in the range 0.6 to 0.15% and Nb in the range 0.02 to 0.05%.

7. Steel strapping according to claim 6, wherein said Ti is present in an amount of about 0.08% and said Nb is present in an amount of about 0.04%.

8. Steel strapping according to claim 1, wherein the steel comprises one or more alloying elements in the form of particles which retard recrystallization.

9. Steel strapping according to claim 1, wherein said carbides are present in the form of cementite.

10. A heat treated cold rolled steel strapping which is characterized by a microstructure comprising a matrix of recovery annealed cold worked ferrite containing martensite and carbides dispersed through said matrix.

11. Steel strapping according to claim 10, wherein the steel comprises one or more alloying elements in the form of particles which retard recrystallization.

12. Steel strapping according to claim 11, wherein the steel contains Ti in the range 0.06–0.15% and Nb in the range 0.02 to 0.05%.

13. Steel strapping according to claim 11, wherein said Ti is present in an amount of about 0.08% and said Nb is present in an amount of about 0.04%.

* * * * *